US009028270B1

(12) United States Patent
Vanderwoud

(10) Patent No.: US 9,028,270 B1
(45) Date of Patent: May 12, 2015

(54) PULL TAB ACTUATOR FOR CONNECTORS

(71) Applicant: Facebook, Inc., Menlo Park, CA (US)

(72) Inventor: Michael Vanderwoud, Menlo Park, CA (US)

(73) Assignee: Facebook, Inc., Menlo Park, CA (US)

( * ) Notice: Subject to any disclaimer, the term of this patent is extended or adjusted under 35 U.S.C. 154(b) by 0 days.

(21) Appl. No.: 14/061,658

(22) Filed: Oct. 23, 2013

(51) Int. Cl.
*H01R 13/633* (2006.01)

(52) U.S. Cl.
CPC ..... *H01R 13/6335* (2013.01)

(58) Field of Classification Search
CPC ..... H01R 13/6272; H01R 13/6275; H01R 13/641
USPC ..... 439/352
See application file for complete search history.

(56) References Cited

U.S. PATENT DOCUMENTS

| | | | | |
|---|---|---|---|---|
| 7,207,823 | B1 * | 4/2007 | Yang | 439/352 |
| 7,238,040 | B1 * | 7/2007 | Wu | 439/352 |
| 7,281,937 | B2 | 10/2007 | Reed et al. | |
| 7,318,740 | B1 * | 1/2008 | Henry et al. | 439/352 |
| D566,651 | S | 4/2008 | Chan et al. | |
| 7,354,124 | B2 * | 4/2008 | Oshima et al. | 347/5 |
| 7,354,292 | B1 * | 4/2008 | Lloyd et al. | 439/352 |
| 7,445,484 | B2 | 11/2008 | Wu | |
| 7,473,124 | B1 * | 1/2009 | Briant et al. | 439/352 |
| 7,666,023 | B2 | 2/2010 | Wu | |
| 7,771,225 | B1 * | 8/2010 | Wu | 439/352 |
| 8,202,122 | B2 * | 6/2012 | Wu | 439/607.47 |
| D675,573 | S | 2/2013 | Farris-Gilbert et al. | |
| D675,992 | S | 2/2013 | Farris-Gilbert et al. | |
| 8,475,198 | B2 * | 7/2013 | Wu | 439/352 |
| 8,475,199 | B2 * | 7/2013 | Wang et al. | 439/353 |
| 8,506,319 | B2 * | 8/2013 | Ritter et al. | 439/352 |
| D695,226 | S | 12/2013 | De Iuliis et al. | |
| 8,668,515 | B2 * | 3/2014 | Wu | 439/352 |
| 8,740,637 | B2 * | 6/2014 | Wang et al. | 439/352 |
| 2006/0189197 | A1 * | 8/2006 | Reed et al. | 439/352 |
| 2007/0243749 | A1 * | 10/2007 | Wu | 439/352 |
| 2009/0291584 | A1 | 11/2009 | Wu | |
| 2012/0052712 | A1 * | 3/2012 | Wang et al. | 439/352 |
| 2013/0344722 | A1 | 12/2013 | Lloyd et al. | |
| 2014/0193993 | A1 * | 7/2014 | Meng et al. | 439/352 |

OTHER PUBLICATIONS

U.S. Appl. No. 29/468,754 by Vanderwoud, M., filed Oct. 2, 2013.
Non-Final Office Action mailed Dec. 29, 2014, for U.S. Appl. No. 29/468,754 of Vanderwoud, M., filed Oct. 2, 2013.

(Continued)

*Primary Examiner* — Gary Paumen
(74) *Attorney, Agent, or Firm* — Perkins Coie LLP

(57) ABSTRACT

Technology is provided for a pull tab actuator for use with a connector having a connector body and a latch member. The pull tab actuator comprises an elongate tab having a tab thickness and opposed first and second end portions. A handle having a height greater than the tab thickness is disposed on the first end portion and extends laterally from the elongate tab. A nub is disposed on the second end portion and is positioned between the connector body and the latch member. The nub is operative to actuate the latch member when the handle is pulled.

20 Claims, 9 Drawing Sheets

(56) References Cited

OTHER PUBLICATIONS

Notice of Allowance mailed Dec. 29, 2014, for U.S. Appl. No. 29/468,754 of Vanderwoud, M., filed Oct. 2, 2013.

FCI High Speed I/O & Cable Assemblies Assemblies, FCI Product Presentation, Cable Assembly Offerings, High Speed—mini-SAS / SATA, pp. 13-17, Jan. 2010. [Accessed on Feb. 11, 2015: http://www.mouser.com/new/fci/fci__mini-sas/].

* cited by examiner

PULL TAB ACTUATOR FOR CONNECTORS

TECHNICAL FIELD

This patent application generally relates to data cable connectors, and more specifically, to an ergonomic data cable connector pull tab actuator.

BACKGROUND

Electrical connectors allow convenient connection and disconnection of electrical devices and components. In a networking environment, for example, connectors connect data cables between network devices. FIG. 1 illustrates a traditional data cable connector 10. Connector 10 is a standard external mini SAS type data cable connector. Connector 10 includes a connector body 12 and a latch member 14. Latch member 14 is actuated by a traditional style pull tab 16 which includes a ring portion 18. In order to release the connector 10 from a mating device, a user pulls tab 16 by engaging ring portion 18 with a thumb 20 and index finger 22, as shown. Pulling the tab 16 actuates latch member 14, thereby releasing the connector from the mating device.

Traditional pull tabs, such as pull tab 16, are typically thin, ribbon-like tabs. These pull tabs typically require a pinching motion to grasp the pull tab. While these traditional pull tabs are functional in that they disengage the connector from the associated device or component, traditional ring tabs are generally only accessible from one side of the cable and are difficult to grasp. Users with larger hands and/or fingers may find it particularly difficult to grasp traditional pull tabs with the requisite pinching motion. While these existing pull tabs are functional, there is a need for a pull tab actuator which is more ergonomic and thus more easily engaged by a user.

BRIEF DESCRIPTION OF THE DRAWINGS

The pull tab actuators introduced here may be better understood by referring to the following Detailed Description in conjunction with the accompanying drawings, in which like reference numerals indicate identical or functionally similar elements.

Figure 1:
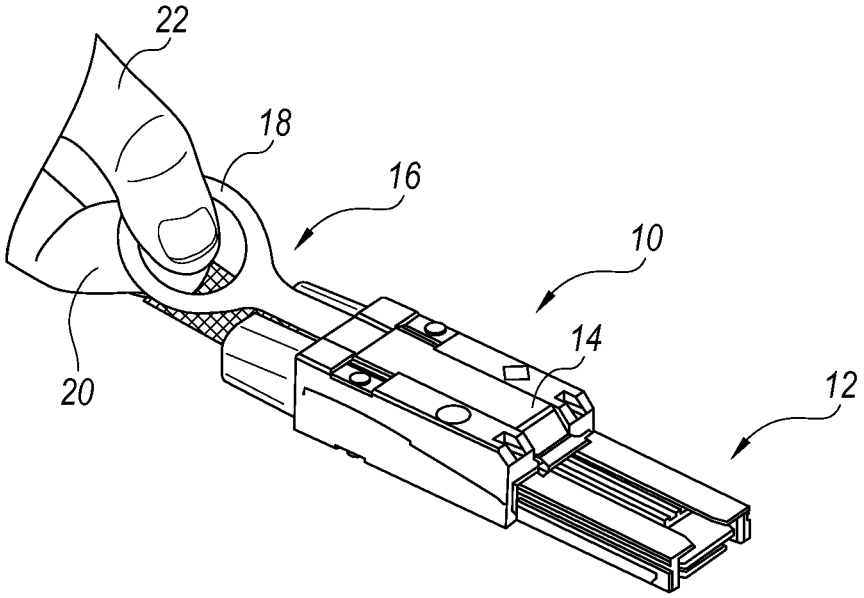
Fig. 1 PRIOR ART
FIG. 1 is a perspective view of a prior art connector having a traditional pull tab.

The headings provided herein are for convenience only and do not necessarily affect the scope or meaning of the claimed invention. Further, the drawings have not necessarily been drawn to scale. For example, the dimensions of some of the elements in the figures may be expanded or reduced to help improve the understanding of the embodiments of the present invention. Moreover, while the disclosed technology is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Overview

Technology is disclosed for a pull tab actuator for use with a connector having a connector body and a latch member ("the technology"). In various embodiments, the pull tab actuator comprises an elongate tab with a handle (e.g., T-handle) disposed on one end and a nub disposed on the opposite end. The nub is positioned between the connector body and the latch member and actuates the latch member when the handle is pulled.

In various embodiments, the handle has a height greater than a thickness of the tab and extends laterally from the elongate tab. In various embodiments, the handle includes an engagement surface facing the connector body that is configured to receive a user's index and middle fingers. In various embodiments, the elongate tab defines a first plane, and the handle defines a second plane normal to the first plane.

General Description

Various examples of the devices introduced above will now be described in further detail. The following description provides specific details for a thorough understanding and enabling description of these examples. One skilled in the relevant art will understand, however, that the techniques discussed herein may be practiced without many of these details. Likewise, one skilled in the relevant art will also understand that the technology can include many other obvious features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the invention. Indeed, some terms may even be emphasized below; however, any terminology intended to be interpreted in any restricted manner will be overtly and specifically defined as such in this section.

Figure 2:
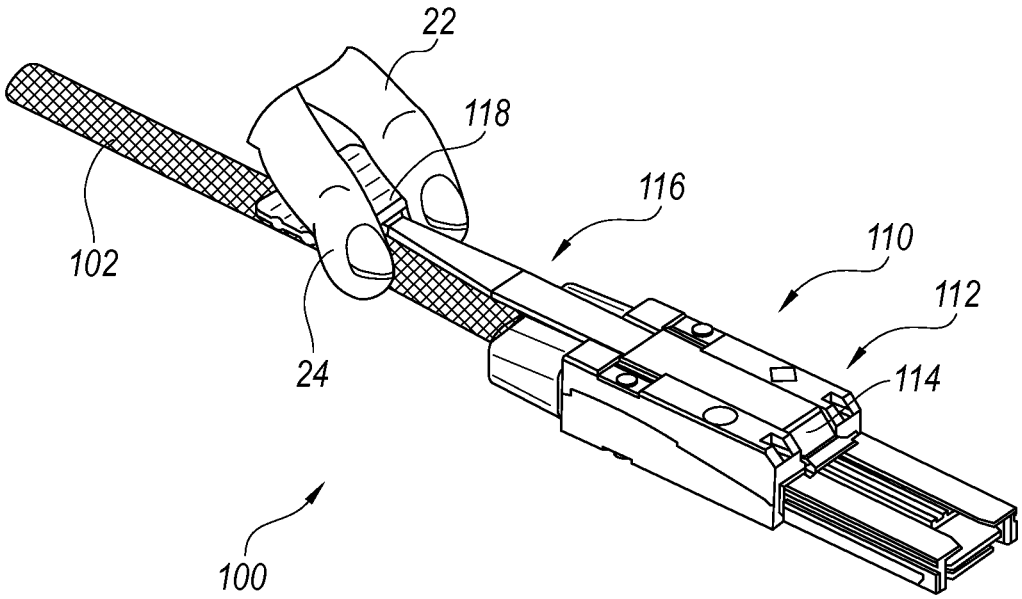
FIG. 2 is a perspective view of a cable assembly incorporating a pull tab actuator according to a representative embodiment of the present technology.

Turning now to the figures, FIG. 2 illustrates a cable assembly 100 including a connector 110 having a pull tab actuator 116 according to a representative embodiment. The cable assembly 100 includes at least one connector 110 and a cable 102. As with the traditional connector 10 described above with respect to FIG. 1, the connector 110 includes a connector body 112 and a latch member 114. In various embodiments, the connector body 112 can be an external SAS or mini SAS style of connector. The pull tab actuator 116 includes a handle 118 configured to receive a user's index finger 22 and middle finger 24. Thus, the pull tab actuator 116 is operative to actuate the latch member 114 when a user pulls on the handle 118. Although the representative embodiments are described herein with respect to SAS style connector bodies, various aspects of the disclosed technology may be applied to other connector configurations such as, for example, and without limitation, DAC connectors.

Figure 3:
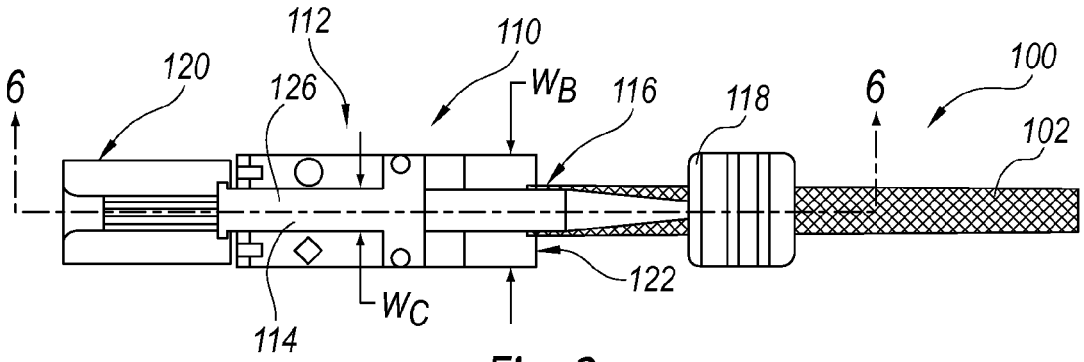
FIG. 3 is a top plan view of the cable assembly shown in FIG. 2.
Figure 4:
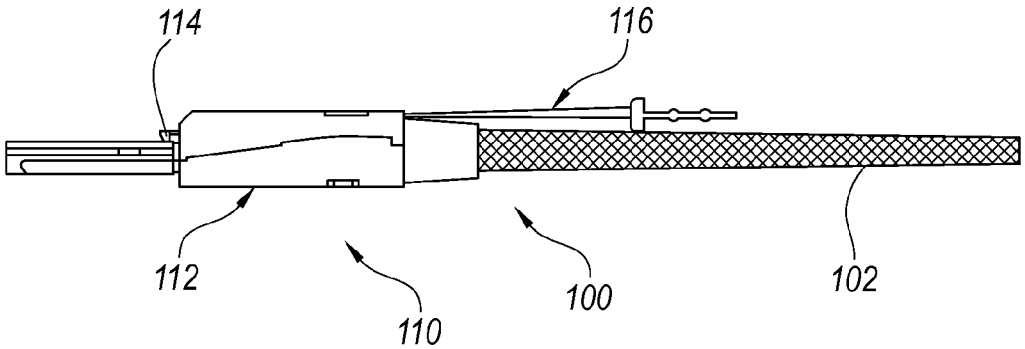
FIG. 4 is a side view in elevation of the cable assembly shown in FIGS. 2 and 3.

With further reference to FIGS. 3 and 4, the connector body 112 includes a terminal end portion 120, a cable receptacle 122, and a channel 126 extending along an outer surface of the connector body 112. The pull tab actuator 116 is positioned in the channel 126 between the connector body 112 and the latch member 114. As shown in FIG. 3, the connector body 112 has a width $W_B$, and channel 126 has a width $W_C$. As shown in the figures, the pull tab actuator 116, as well as the latch member 114, have a width approximately equal to the channel width $W_C$.

Figure 5:
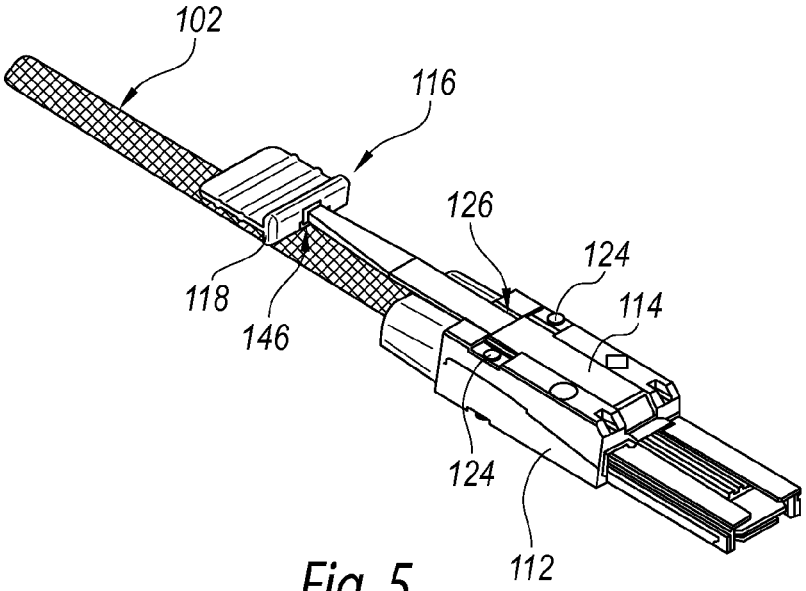
FIG. 5 is a perspective view of the cable assembly shown in FIGS. 2-4.

Referring to FIG. 5, the latch member 114 is attached to the connector body 112 and extends along at least a portion of the channel 126. In some embodiments, the latch member 114 is attached to the connector body 112 with appropriate fasteners, such as rivets 124. Also shown in FIG. 5, the handle 118 includes a notch 146 configured to receive the cable 102. The notch 146 helps keep the pull tab actuator 116 centered in position along the cable 102.

Figure 6:
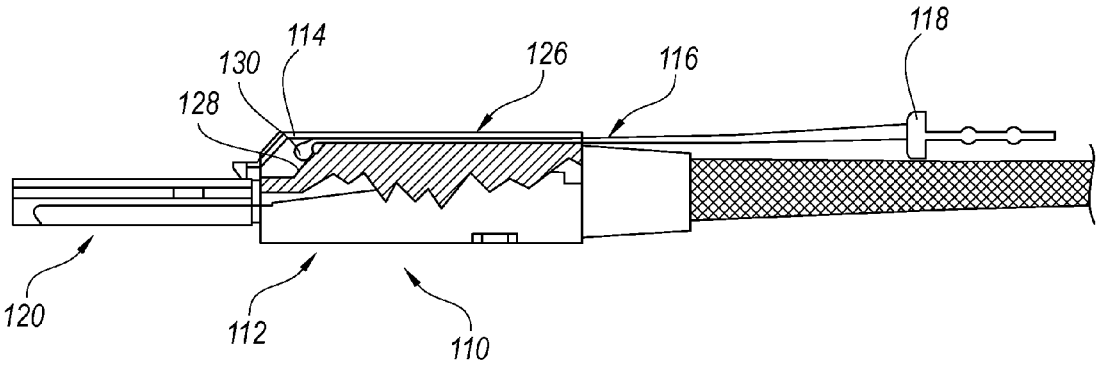
FIG. 6 is a partial cross-section of the connector shown in FIG. 3 taken about line 6-6.

With further reference to FIG. 6, the channel 126 includes a ramped region 128 which receives a nub 130 disposed on the pull tab actuator 116. The nub 130 is positioned in the channel 126 between the ramped region 128 and the latch member 114. Accordingly, when the handle 118 is pulled, the nub 130 travels along the ramped region 128 to lift or actuate the latch member 114, thereby disengaging the connector 110 from an associated device or component to which it is connected. It should be appreciated that in FIG. 6, the latch member 114 is shown in a latched position, and when actuated, the latch member 114 moves to an unlatched position. The latch member 114 is spring-biased to the latched position. For example, the latch member 114 can be comprised of a spring steel material, a suitable stainless steel such as S304, or other resilient yet flexible material. Accordingly, when the pull tab actuator 116 is released, the latch member 114 returns to the latched position.

Figure 7:
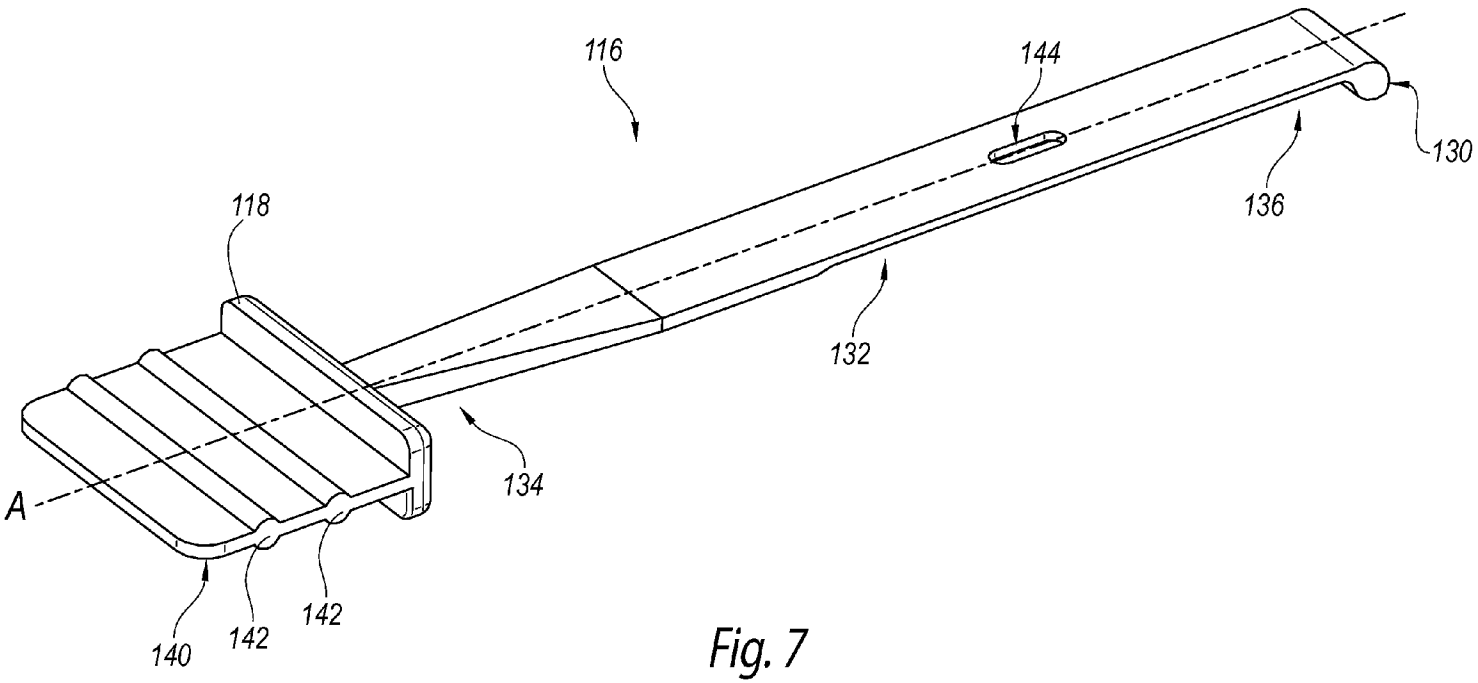
FIG. 7 is a perspective view of the pull tab actuator shown in FIGS. 2-6.

As shown in FIG. 7, the pull tab actuator 116 includes an elongate tab 132 having a longitudinal axis A with a first end portion 134 and an opposite second end portion 136. The handle 118 is disposed on the first end portion 134, and the nub 130 is disposed on the second end portion 136. The nub 130 is an enlarged end portion of the elongate tab 132. In this embodiment, the nub 130 is in the form of a lobe which extends across the width of the second end portion and depends downwardly from the second end portion and toward the ramped region 128 (see FIG. 6). The elongate tab 132 also includes a slot 144 which is configured to engage a peg (not shown) within the channel 126. The peg and slot arrangement limits the actuation stroke of the pull tab actuator 116.

In some embodiments, the pull tab actuator 116 may also include a planar pinch grip 140 extending from the handle portion 118. In this embodiment, the pinch grip 140 includes a plurality of gripping features 142. The gripping features 142 extend laterally with respect to the axis A of the pull tab actuator 116. In this embodiment, the gripping features are in the form of raised ridges; however, in other embodiments, the gripping feature can take different forms, such as, for example and without limitation, grooves, bumps, holes, divots, or the like.

Figure 8:
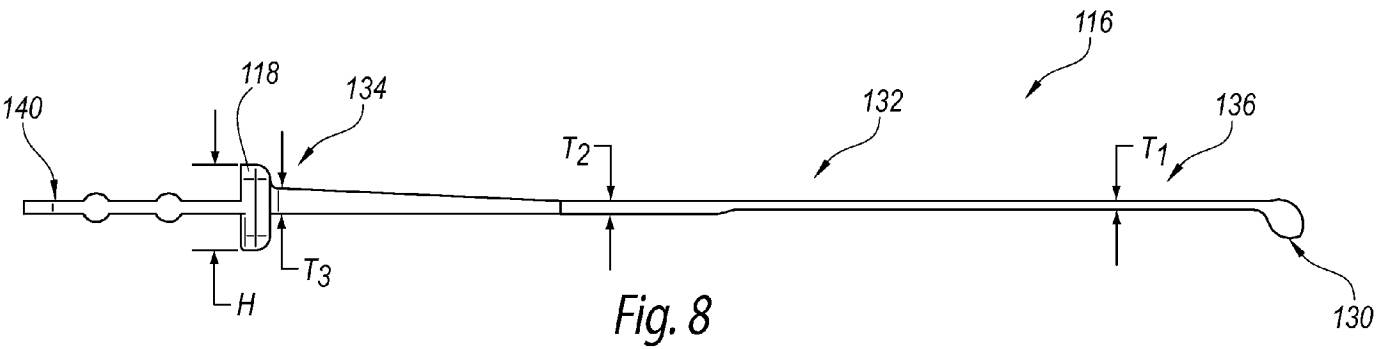
FIG. 8 is a side view in elevation of the pull tab actuator shown in FIG. 7.

As shown in FIG. 8, the elongate tab 132 can have varying thicknesses. For example, the thickness can vary from a first thickness $T_1$ at the second end portion 136, to a second thickness $T_2$, and finally to a third thickness $T_3$ at the first end portion 134. Thickness $T_1$ allows the pull tab actuator 116 to be positioned in the channel 126 between the connector body 112 and the latch member 114 (see FIG. 6). The thickness increases at $T_2$ and ramps up in thickness to $T_3$ in order to provide stiffness to the pull tab actuator 116. It can be appreciated from the figure that handle 118 has a height H greater than the thickness of the elongate tab 132.

Figure 9:
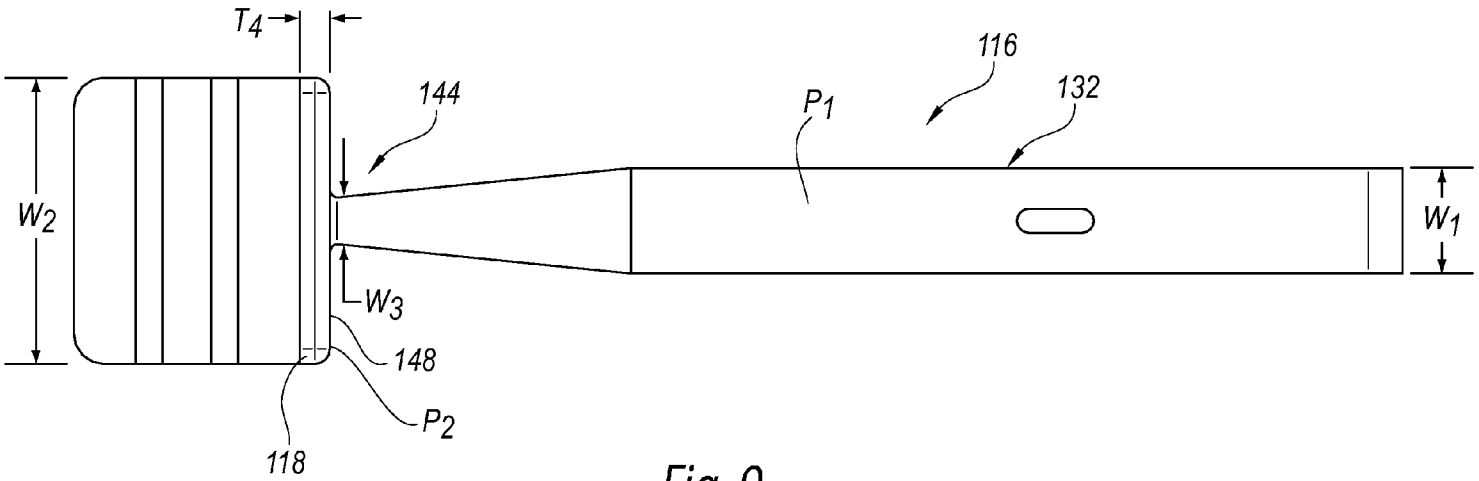
FIG. 9 is a top plan view of the pull tab actuator shown in FIGS. 7 and 8.

As shown in FIG. 9, the elongate tab 132 has a width $W_1$, and handle 118 has a width $W_2$. In various embodiments, the width $W_1$ of the elongate tab 132 is approximately equal to the width $W_C$ of the channel 126 (see FIG. 3). In another embodiment, the width $W_2$ of handle 118 can be approximately equal to the width $W_B$ of the connector body 112 (see FIG. 3). In some embodiments, elongate tab 132 includes a neck portion 144 having a width $W_3$ adjacent to handle 118 that is less than $W_1$. The neck portion 144 provides additional engagement surface area for the user's fingers to engage the handle 118. Also shown in FIG. 9, the handle 118 has a thickness $T_4$, selected in conjunction with height H (see FIG. 8), to provide sufficient stiffness to the handle 118 to resist bending or breaking under the pulling force necessary to actuate the latch member 114 (see FIG. 6). In various embodiments, the pull tab actuator 116 can be comprised of any suitable material such as plastic, rubber, and metal, for example. In various embodiments, the pull tab actuator can comprise, for example and without limitation, nylon, acrylonitrile butadiene styrene (ABS), poly vinyl chloride (PVC), high-density polyethylene (HDPE), and the like.

The handle 118 includes an engagement surface 148 facing the connector body 112 that is configured to receive a user's index finger 22 and middle finger 24, as explained above with respect to FIG. 2. In some embodiments, the engagement surface 148 is normal to the longitudinal axis A of the elongate tab 132 (see FIG. 7). In various embodiments, the elongate tab 132 defines a first plane $P_1$, and the handle 118 defines a second plane $P_2$ that is oriented normal to plane $P_1$.

Figure 10:
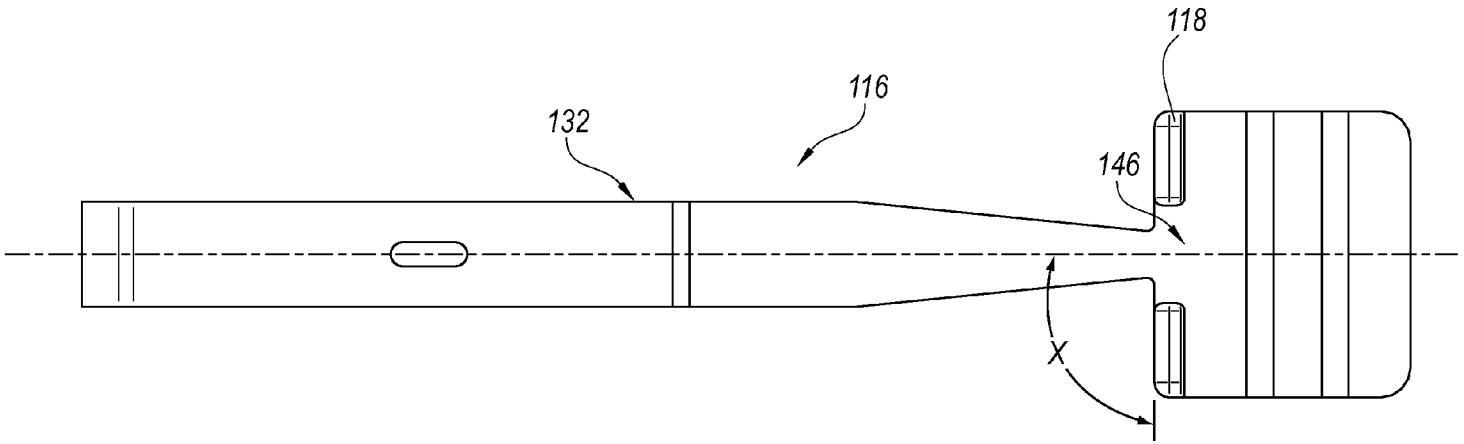
FIG. 10 is a bottom plan view of the pull tab actuator shown in FIGS. 7-9.

As shown in FIG. 10, the handle 118 extends laterally from elongate tab 132 at an angle X. In this embodiment, the handle 118 extends transversely, or orthogonally, from elongate tab 132 at an angle of approximately 90 degrees. It should be appreciated that in this configuration, the handle 118 can be described as a T-handle or T-tab. However, in other embodiments, the handle 118 can extend laterally at an acute angle or an obtuse angle. For example, the handle 118 may extend from elongate tab 132 at an angle ranging from between about 45 degrees to about 135 degrees.

Figure 11:
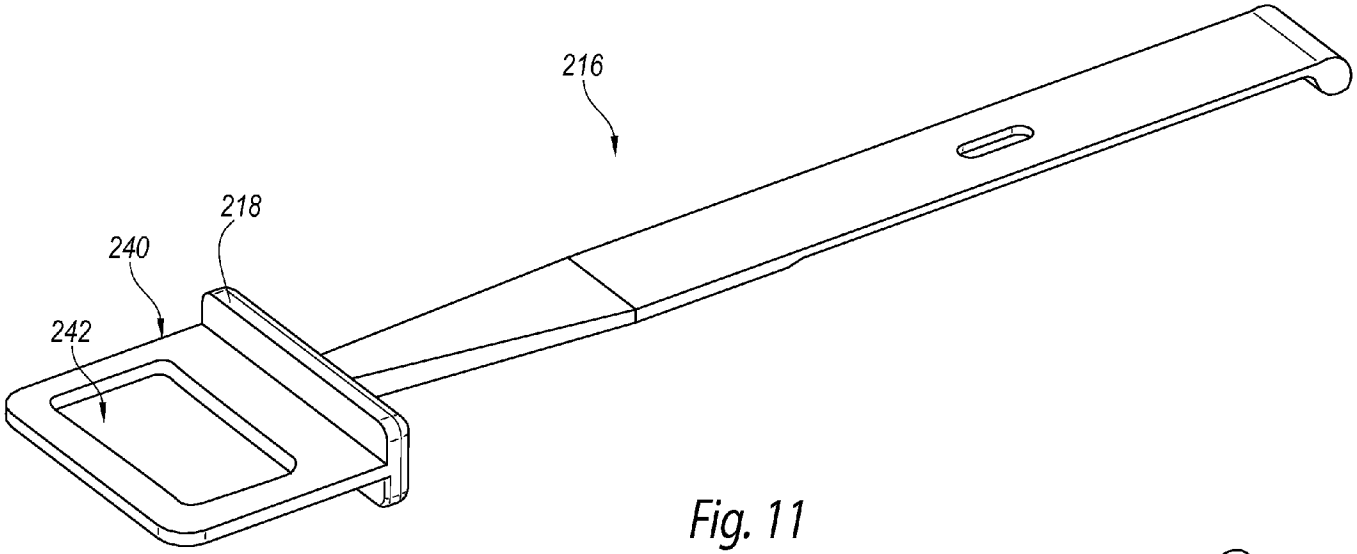
FIG. 11 is a perspective view of a pull tab actuator according to another representative embodiment.
Figure 12:
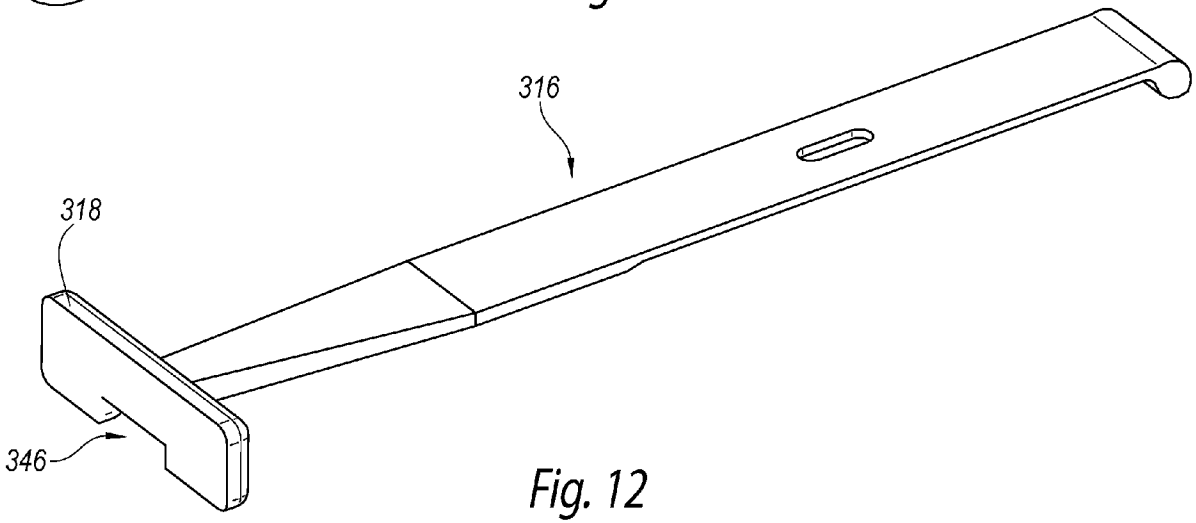
FIG. 12 is a perspective view of a pull tab actuator according to a further representative embodiment.
Figure 13:
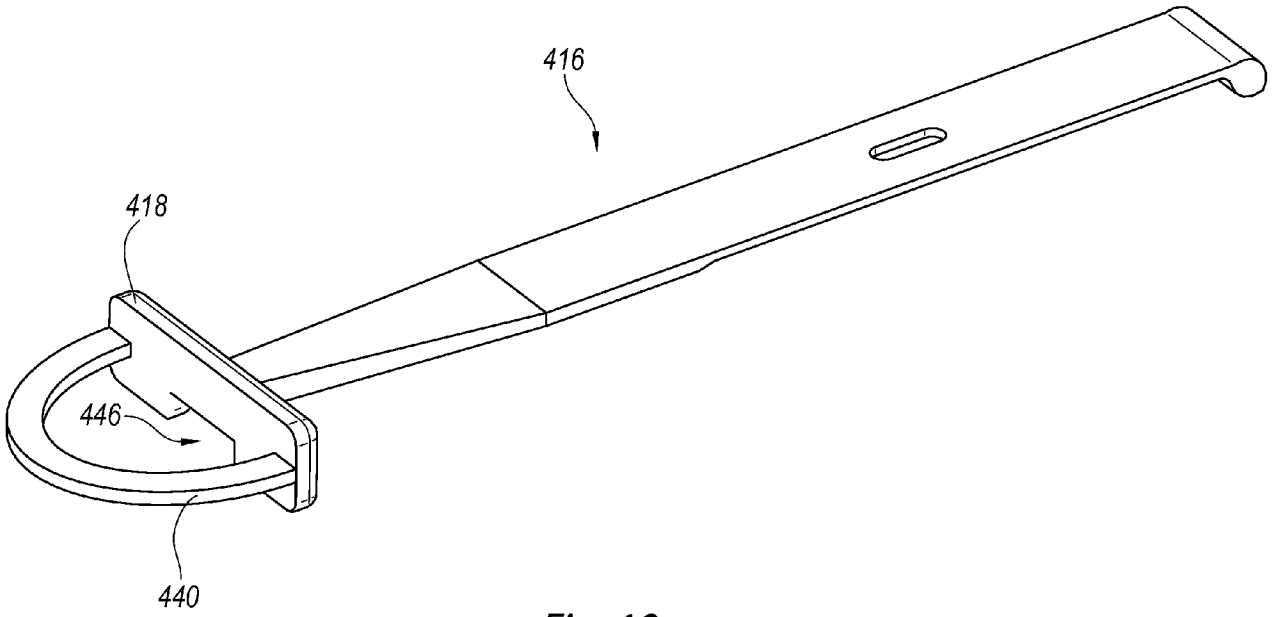
FIG. 13 is a perspective view of a pull tab actuator according to yet another representative embodiment.
Figure 14:
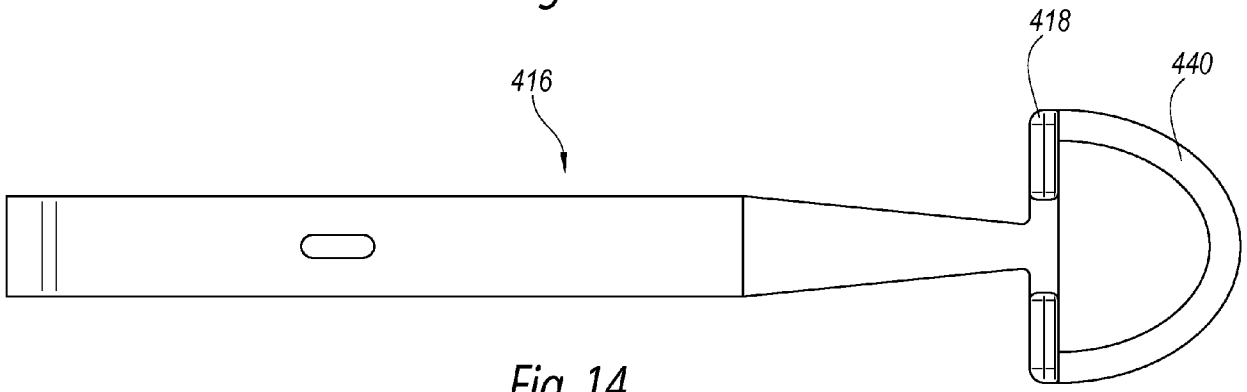
FIG. 14 is a top plan view of the pull tab actuator shown in FIG. 13.
Figure 15:
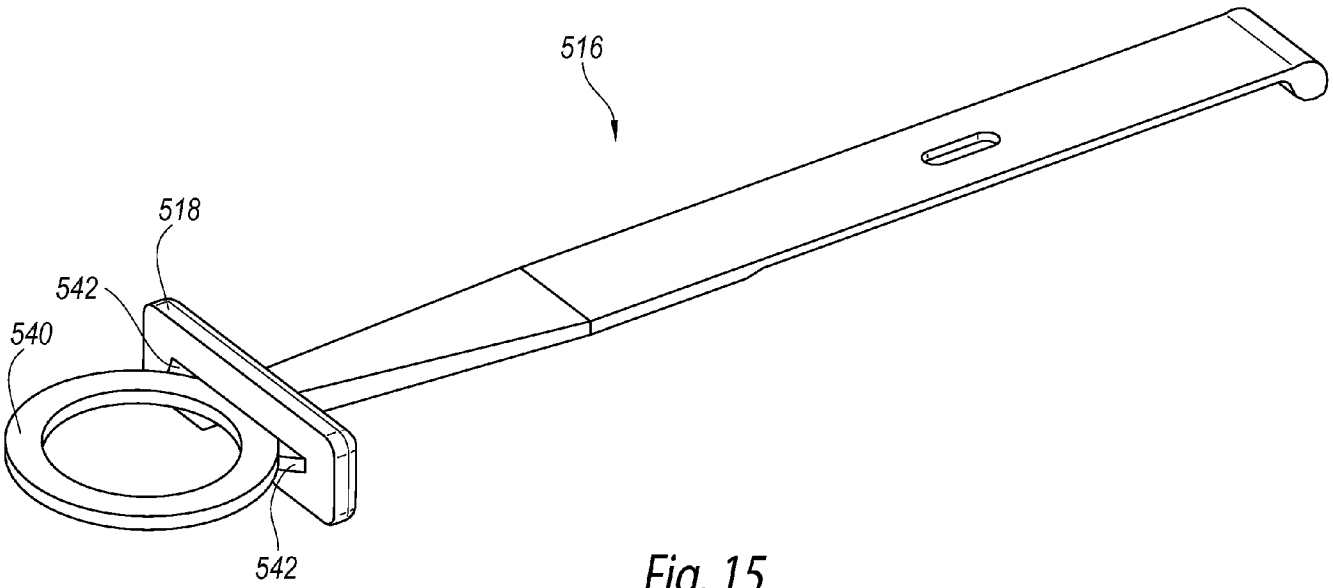
FIG. 15 is a perspective view of a pull tab actuator according to another representative embodiment.
Figure 16:
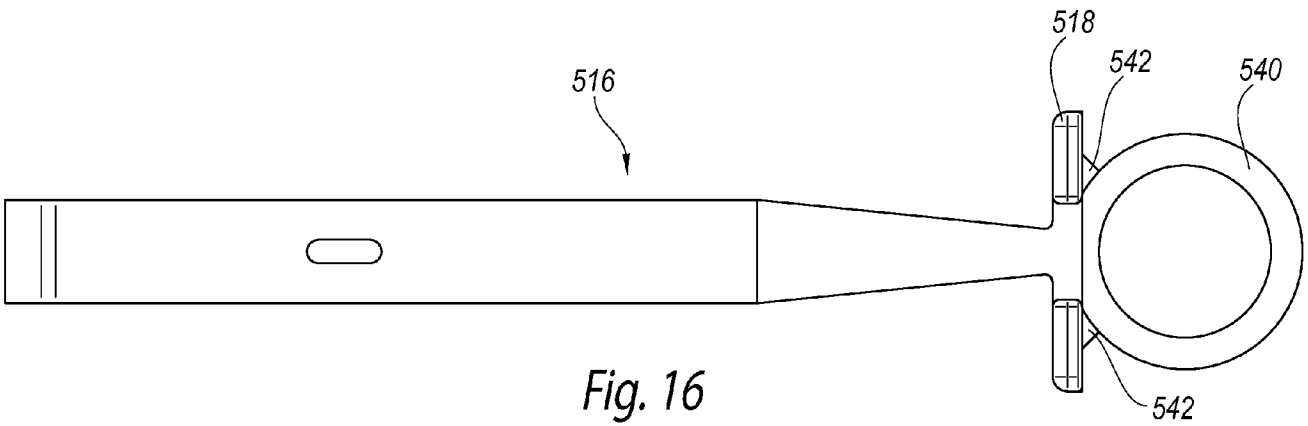
FIG. 16 is a top plan view of the pull tab actuator shown in FIG. 15.

FIG. 11 illustrates a pull tab actuator 216 according to another representative embodiment. In this embodiment, the pull tab actuator 216 includes a handle 218 and a pinch grip 240 extending from the handle. The pinch grip 240 includes an aperture 242 to facilitate gripping the pinch grip 240. FIG. 12 illustrates a pull tab actuator 316 according to a further representative embodiment. The pull tab actuator 316 includes a handle 318 and a corresponding notch 346. As can be appreciated from the figure, handle 318 does not include a pinch grip. FIGS. 13 and 14 illustrate a pull tab actuator 416 according to another representative embodiment. The pull tab actuator 416 includes a handle 418 with a pinch grip in the form of an arcuate loop 440. Handle 418 also includes a cable receiving notch 446 similar to notch 146 described above. FIGS. 15 and 16 illustrate a pull tab actuator 516 according to a still further representative embodiment. Pull tab actuator 516 includes a handle 518 with a loop pinch grip 540 extending therefrom. Pinch grip 540 is in the form of a circular loop having gussets 542 disposed between the pinch grip 540 and handle 518.

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the invention. Accordingly, the invention is not limited except as by the appended claims.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A pull tab actuator for use with a connector having a connector body and a latch member, the pull tab actuator comprising:

an elongate tab having a tab thickness and opposed first and second end portions;

a handle having a height greater than the tab thickness disposed on the first end portion and extending laterally from the elongate tab;

a pinch grip extending from the handle and having a thickness less than the height of the handle; and a nub disposed on the second end portion and positioned between the connector body and the latch member, the nub being operative to actuate the latch member when the handle is pulled.

2. The pull tab actuator according to claim 1, wherein the handle extends laterally from the elongate tab at an acute angle.

3. The pull tab actuator according to claim 1, wherein the handle extends laterally from the elongate tab at an angle between about 45 degrees and about 135 degrees.

4. The pull tab actuator according to claim 1, wherein the handle extends laterally from the elongate tab at an angle of approximately 90 degrees.

5. The pull tab actuator according to claim 1, wherein the elongate tab includes a neck portion adjacent the handle.

6. The pull tab actuator according to claim 1, wherein the pinch grip includes a plurality of transversely extending gripping features.

7. The pull tab actuator according to claim 6, wherein the gripping features comprise ridges.

8. The pull tab actuator according to claim 6, wherein the gripping features comprise grooves.

9. The pull tab actuator according to claim 1, wherein the pinch grip comprises a loop.

10. A connector, comprising:

a connector body including a cable receptacle, a terminal end portion, and a channel extending along an outer surface of the connector body, the channel including a ramped region proximate the terminal end portion;

a latch member mounted to the connector body and extending along at least a portion of the channel; and a pull tab actuator including:

an elongate tab having a longitudinal axis and opposed first and second end portions;

a handle disposed on the first end portion and including an engagement surface normal to the longitudinal axis and facing the connector body configured to receive an index finger and a middle finger of a user;

a pinch grip extending from the handle and having a thickness less than a height of the handle; and a nub disposed on the second end portion and positioned in the channel between the ramped region and the latch member and operative to actuate the latch member when the handle is pulled.

11. The connector according to claim 10, wherein the handle portion includes a notch configured to receive a cable extending from the cable receptacle.

12. The connector according to claim 10, wherein the second end portion of the elongate tab has a width approximately equal to a width of the channel.

13. The connector according to claim 10, wherein the handle has a width approximately equal to a width of the connector body.

14. The connector according to claim 10, wherein the nub is in the form of a lobe extending across a width of the second end portion.

15. A cable assembly, comprising:

at least one connector including:

a connector body including a cable receptacle, a terminal end portion, and a channel extending along an outer surface of the connector body, the channel including a ramped region proximate the terminal end portion;

a latch member mounted to the connector body and extending along at least a portion of the channel; and a pull tab actuator including:

an elongate tab having a longitudinal axis and opposed first and second end portions, wherein the elongate tab defines a first plane;

a handle disposed on the first end portion defining a second plane normal to the first plane;

a pinch grip extending from the handle and having a thickness less than a height of the handle; and a nub disposed on the second end portion and positioned in the channel between the ramped region and the latch member and operative to actuate the latch member when the handle is pulled; and a cable extending from the cable receptacle.

16. The cable assembly according to claim 15, wherein the handle portion includes a notch configured to receive the cable.

17. The cable assembly according to claim 15, wherein the second end portion of the elongate tab has a width approximately equal to a width of the channel.

18. The cable assembly according to claim 17, wherein the first end portion of the elongate tab includes a neck portion adjacent the handle.

19. The cable assembly according to claim 18, wherein the handle has a width approximately equal to a width of the connector body.

20. The cable assembly according to claim 19, wherein the nub is in the form of a lobe extending across a width of the second end portion.

* * * * *